US006302102B1

(12) United States Patent
Giroux et al.

(10) Patent No.: US 6,302,102 B1
(45) Date of Patent: Oct. 16, 2001

(54) DUAL AIR PASSAGE SNORKLE

(76) Inventors: Edward J. Giroux, 2274 Addaleen, Highland, MI (US) 48357; Gerald D. Smith, 3040 W. Coon Lake Rd., Howell, MI (US) 48843

( * ) Notice: Subject to any disclaimer, the term of this patent is extended or adjusted under 35 U.S.C. 154(b) by 0 days.

(21) Appl. No.: 09/303,448

(22) Filed: May 3, 1999

(51) Int. Cl.[7] ..... B23C 11/16
(52) U.S. Cl. ..... 128/201.11; 128/201.28
(58) Field of Search ..... 128/201.11, 201.27, 128/201.28, 202.27; 24/489

(56) References Cited

U.S. PATENT DOCUMENTS

| | | | | |
|---|---|---|---|---|
| 46,902 | | 3/1865 | Hawkins . | |
| 488,088 | * | 12/1892 | Pettibone | 24/489 |
| 531,415 | * | 12/1894 | Harding | 24/489 |
| 606,729 | * | 7/1898 | Moulton | 24/489 |
| 762,629 | * | 6/1904 | Greenberg | 24/489 |
| 2,362,775 | | 11/1944 | Sebouh . | |
| 3,721,236 | | 3/1973 | Bardehle . | |
| 3,805,778 | * | 4/1974 | Garrahan | 128/201.27 |
| 3,945,092 | * | 3/1976 | Andrews | 24/489 |
| 3,956,805 | * | 5/1976 | Stroh | 24/489 |
| 4,310,001 | * | 1/1982 | Comben | 128/202.27 |
| 4,380,232 | * | 4/1983 | Doyle | 128/201.11 |
| 4,655,212 | * | 4/1987 | Delphia | 128/201.11 |
| 4,907,582 | * | 3/1990 | Meyerrose | 128/201.11 |
| 4,910,806 | * | 3/1990 | Baker et al. | 128/201.11 |
| 5,117,817 | | 6/1992 | Lin . | |
| 5,143,059 | * | 9/1992 | Delphia | 128/201.11 |
| 5,239,990 | * | 8/1993 | Delphia | 128/201.11 |
| 5,664,558 | | 9/1997 | Wagner . | |

FOREIGN PATENT DOCUMENTS

| | | | | |
|---|---|---|---|---|
| 189504 | * | 4/1957 | (DE) | 128/201.11 |

* cited by examiner

*Primary Examiner*—Aaron J. Lewis
(74) *Attorney, Agent, or Firm*—Young & Basile, P.C.

(57) ABSTRACT

A "dry" diving snorkel having an elongated body and separate air inlet and exhaust passages defined in the body. The snorkel body is of an arcuate configuration and the lower side of the body upper end faces downwardly during normal use. Air inlet and exhaust ports are defined in the snorkel body upper end lower side in side-by-side relationship, and a diaphragm valve is located within each port biased toward a normally closed condition. The mouthpiece at the body lower end includes a water drain valve, and a strap clamp is molded into the body configuration.

1 Claim, 3 Drawing Sheets

FIG-1
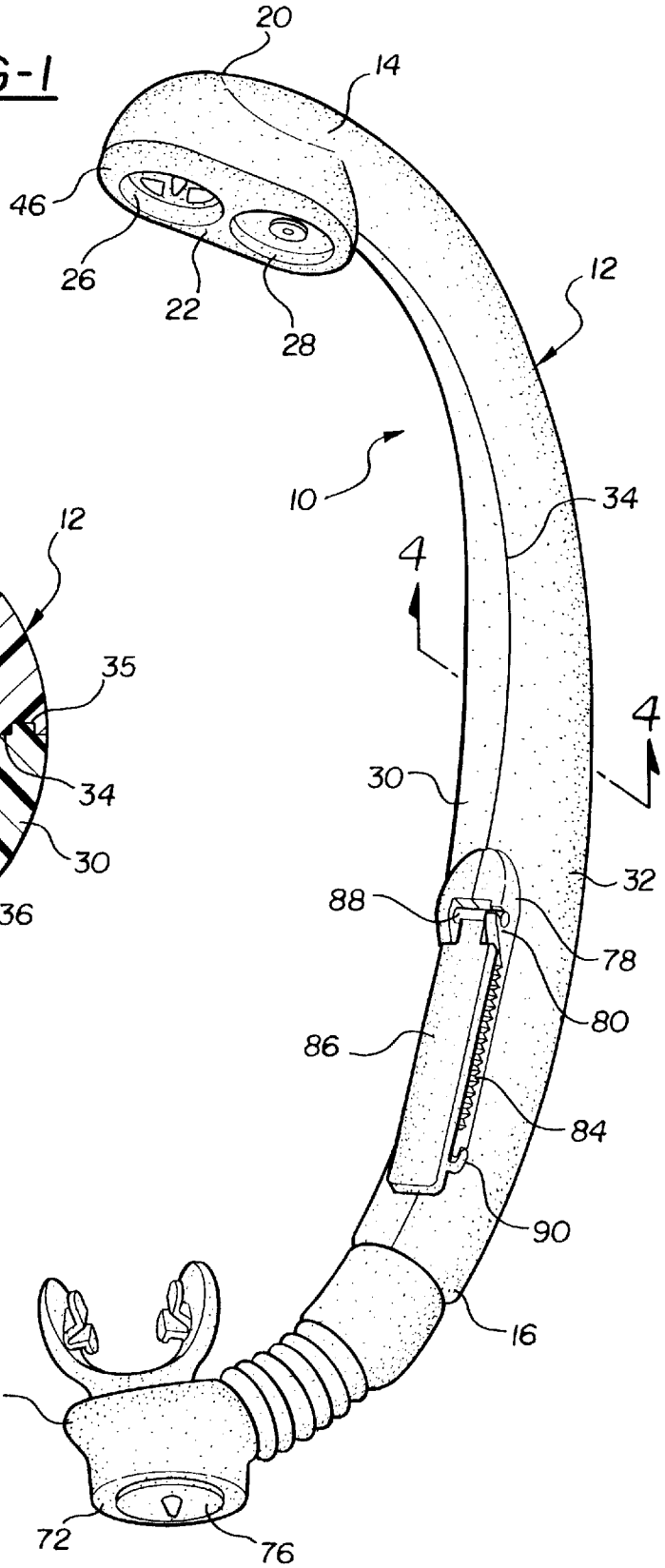
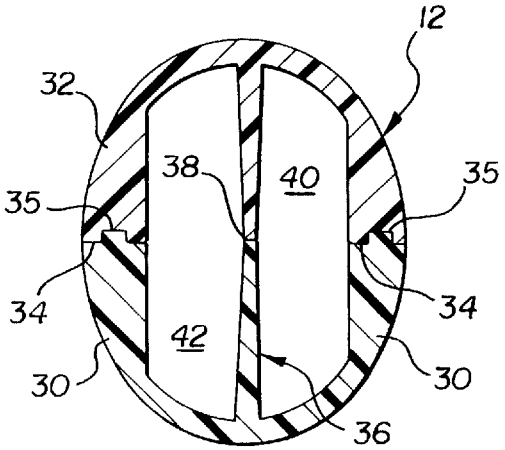
FIG-4

DUAL AIR PASSAGE SNORKLE

BACKGROUND OF THE INVENTION

1. Field of the Invention

The invention pertains to diving snorkels of the "dry" type utilizing separate passages for inlet air and exhaust air.

2. Description of the Related Art

Originally, diving snorkels consisted only of a shaped tube whereby the diver could breathe through the tube while the face was submerged. Over the years, more sophisticated snorkel constructions have utilized valves to close the snorkel to the entrance of water when the snorkel is entirely submerged, for instance when the diver dives. "Dry" snorkels have been developed wherein valves are utilized to minimize the entrance of water into the valve body during snorkel submersion, however, as the usual snorkel construction uses a single passage for both inlet and exhaust air, the clearing of the exhaust air from the snorkel prior to drawing clean air therein requires greater difficulty than involved in normal breathing, and the majority of snorkel constructions do not separate inlet or inhaled air from expired air.

Attempts have been made to devise snorkels having a plurality of air passages, and devices of this type are shown in U.S. Pat. Nos. 46,902; 2,362,775; 3,721,236; 5,117,817; and 5,664,558. However, the snorkels disclosed in the aforementioned patents are either unduly burdensome, heavy or expensive, and are not capable of readily maintaining separation of air inlet and exhaust air control, and such devices are of such complexity as to substantially raise the cost of the snorkel. In U.S. Pat. No. 5,664,558, separate passages for air inlet and exhaust air are shown, but the valving therefor is not so located and positioned with respect to the snorkel construction as to provide optimum advantages such as those achieved by the invention.

OBJECTS OF THE INVENTION

It is an object of the invention to provide an attractive dry diving snorkel molded of a synthetic plastic material wherein the snorkel body includes separate air passages for inlet and exhaled exhaust air.

A further object of the invention is to provide a dry attractive diving snorkel having separate passages for inlet and exhaled air, and where the upper end of the snorkel includes separate valving for each passage and prevents significant intermixing of fresh air and exhaled air in the snorkel body.

Yet another object of the invention is to provide a dry molded snorkel having separate air inlet and air exhaust passages and valved ports wherein the passage valves are located on the underside of the upper end of the snorkel body in side-by-side relationship to produce optimum water shedding and protection from dynamic water pressure.

Yet a further object of the invention is to provide a molded synthetic plastic diving snorkel having an integral strap clamp wherein the strap clamp components are simultaneously molded at the time of the molding of the snorkel body.

SUMMARY OF THE INVENTION

The snorkel body is molded of a synthetic material, normally a thermoplastic material, in two mirror image parts which are then aligned and bonded together to define a tubular body having upper and lower ends.

A barrier wall is defined within the body halves whereby assembly of the halves defines two separate air passages, one for inlet air, and one for exhaled exhaust air, the passages extending throughout the body length.

The snorkel body is of a curved configuration wherein the underside of the snorkel body upper end is in opposed relationship to the upper side of the body lower end. Elastic diaphragm valves are located within the air inlet passage and exhaled exhaust air passage within the ports of the passages as defined in the body on the underside of the snorkel body upper end. These ports are in side-by-side relationship and extend downwardly whereby water shedding from the snorkel body upon the snorkel breaking the water surface does not enter the air ports and passages.

An elastic uni-directional diaphragm valve is located within the port of each passage of the snorkel. The diaphragm valves are pre-tensioned in such a manner as to be normally closed except when air passes through the passage in the pre-determined direction, and the normal closed relationship assures a "dry" snorkel wherein the snorkel air passages will be free of water even when the snorkel is submerged.

An elastic mouthpiece is affixed to the lower end of the snorkel body communicating with the body lower end and the air passages defined therein. A diaphragm-type water drain valve may be located within the mouthpiece to aid in maintaining the air passages free of water.

A strap clamp is integrally molded on the body halves including hinge, shoulder and strap clamping areas whereby a cover hingedly mounted on the hinge having a lip selectively cooperating with the shoulder permits the diver's mask strap to be trapped within the clamp for holding the snorkel in position during use.

The construction of the snorkel of the invention results in a very attractive modern appearance which is highly functional, separates fresh and exhaled exhausted air, maintains the air passages substantially free of water, and requires no special attention by the user.

BRIEF DESCRIPTION OF THE DRAWINGS

The aforementioned objects and advantages of the invention will be appreciated from the following description and accompanying drawings wherein:

FIG. 1 is a perspective view of a snorkel in accord with the invention,

FIG. 4 is an elevational sectional view taken through the snorkel body along Section 4–4 of FIG. 1.

DESCRIPTION OF THE PREFERRED EMBODIMENT

Figure 2:
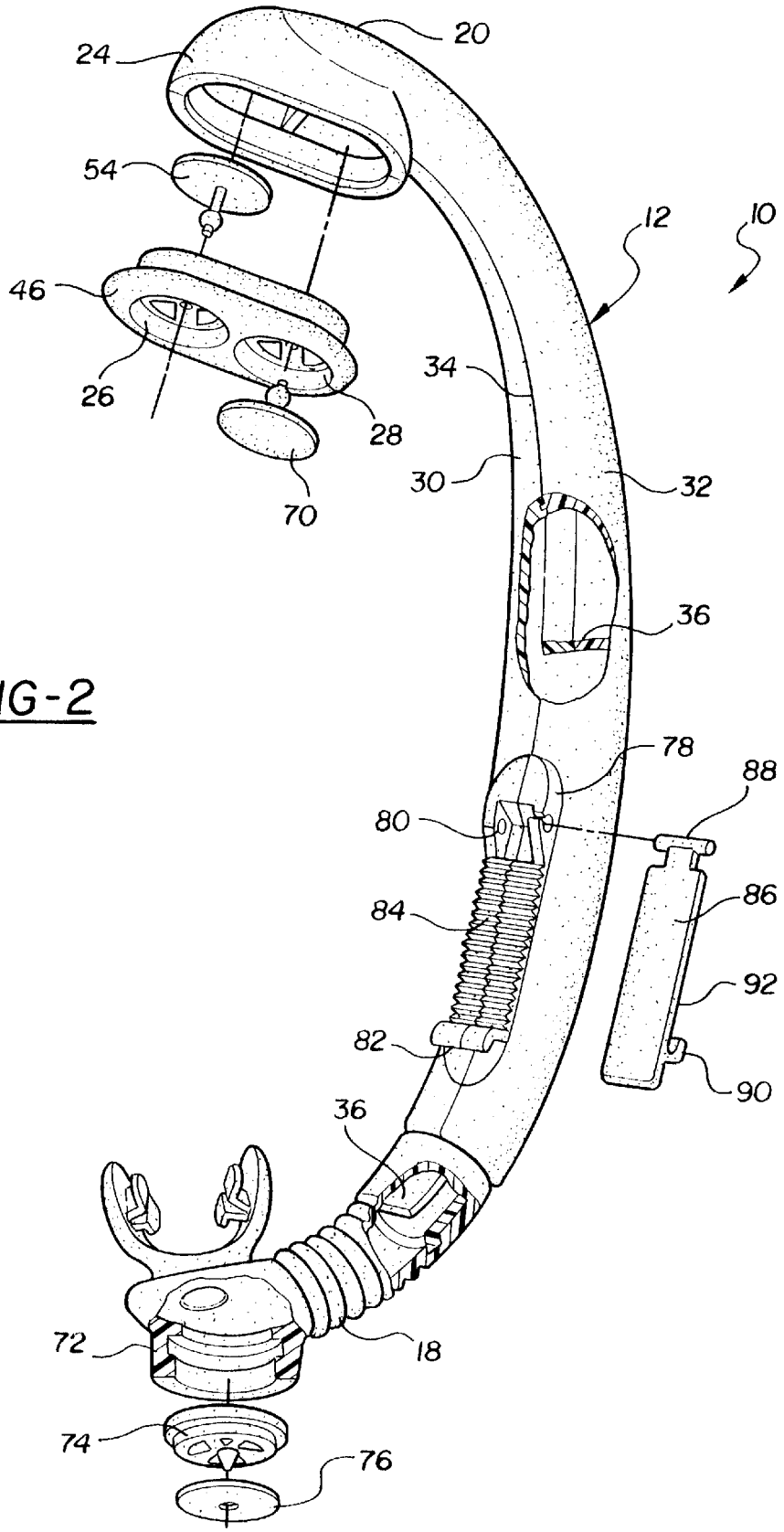
FIG. 2 is an exploded view, partially sectioned, illustrating the various components of the snorkel.

The overall appearance of a snorkel constructed in accord with the invention will be appreciated from FIG. 1 wherein the snorkel is shown in its entire assembled configuration. The snorkel includes a tubular body 12 of an arcuate configuration having an upper end 14 and a lower end 16. An elastic mouthpiece 18 is affixed to the body lower end 16 in communication therewith. The snorkel body upper end 14 includes a convex upper side 20, and a lower side 22 which faces the mouthpiece 18 as will readily be appreciated from FIG. 1. A bulbous valve housing 24 is defined on the body lower side 22 of the upper end 14 and a fresh air inlet port 26 and an exhaled air exhaust port 28 are defined in the valve housing 24 and the ports 26 and 28 extend toward the mouthpiece 18 as will be appreciated from FIG. 1.

The snorkel body 12 is preferably molded of a synthetic thermoplastic material and includes body halves 30 and 32 which are of a mirror image with respect to each other and may be assembled by conventional adhesive or ultrasonic welding. Each of the body halves 30 and 32 is formed with a parting line 34 including a tongue and groove configuration 35, FIG. 4, whereby the body halves 30 and 32 may be accurately assembled in an airtight manner and the tongue and groove interrelationship, in addition to the adhesive or bonding, produces a high strength airtight body.

Figure 3:
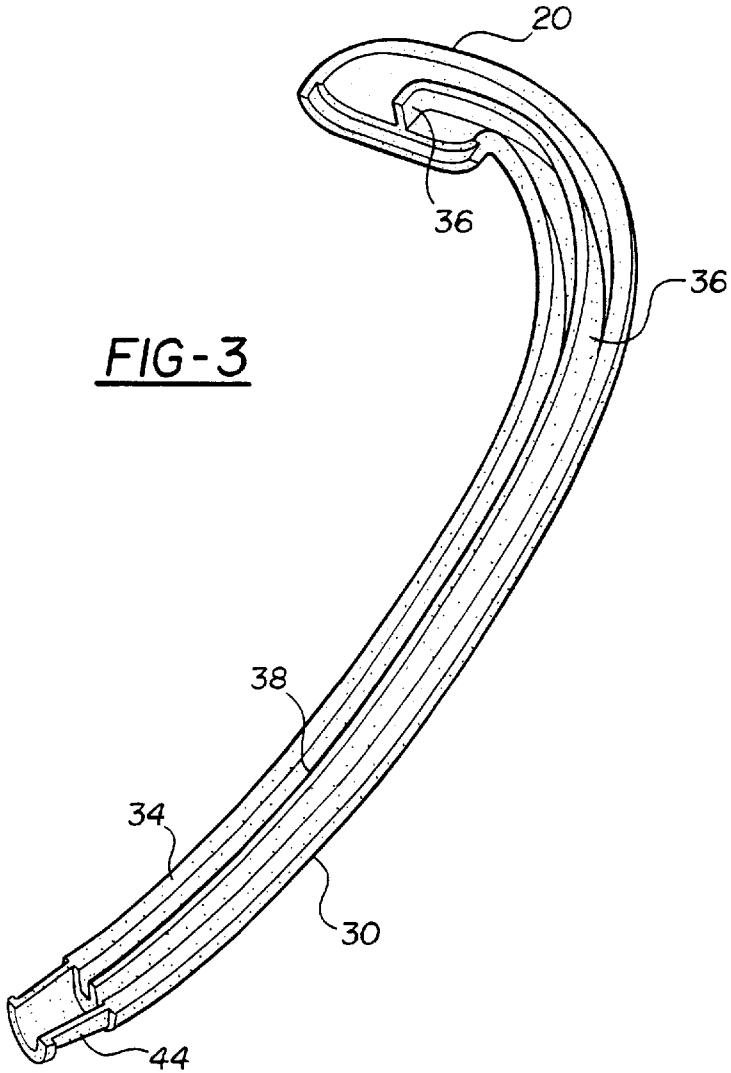
FIG. 3 is a perspective view of one-half of the snorkel body prior to assembly with the other snorkel body half.

Each of the halves 30 and 32 includes a barrier wall 36 centrally located within the associated body half as will be appreciated from FIGS. 3 and 4. The barrier walls 36 each include a parting line 38 so that when the halves 30 and 32 are assembled, the parting lines 38 will engage and the barrier walls 36, together, define an air impervious structure defining a fresh inlet air passage 40 and an exhaled air exhaust passage 42 within the body 12 throughout its length. As will be appreciated from FIGS. 3 and 5, the upper end of the barrier wall 36 is bent downwardly to maintain separation between the passages 40 and 42. At their lower ends, the passages 40 and 42 communicate with the mouthpiece lip 44 upon which the mouthpiece 18 is mounted.

Figure 5:
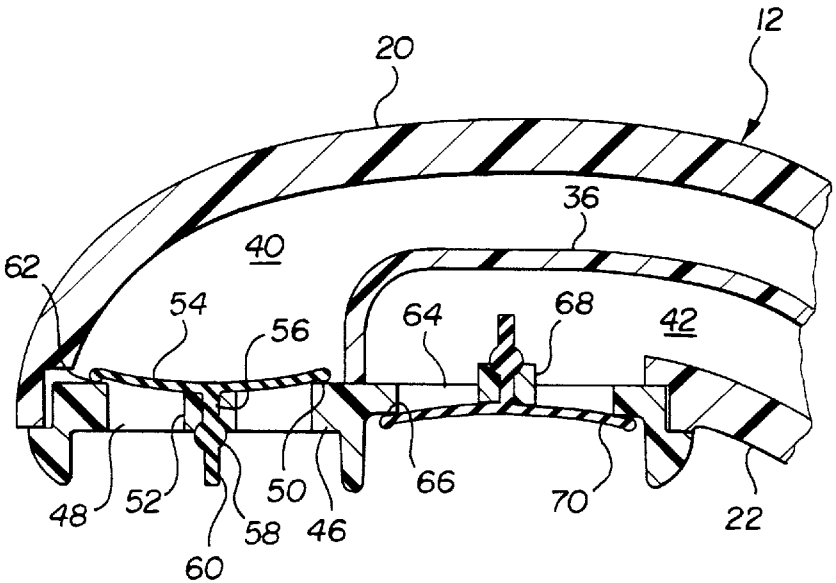
FIG. 5 is an enlarged detail elevational sectional view of the upper end of the snorkel body illustrating the valved port structure.

A molded valve housing 46, FIG. 5, is mounted within the valve housing 24 in an airtight relationship to the body valves 30 and 32, and the barrier wall 36. The valve cover 46 includes an inlet spider opening 48 defining an annular seat 50 and having a central hub 52 having an axial bore. A resilient diaphragm valve 54 extends over the spider 48 and the valve hub 56 includes a ball 58 which is pulled through the hub 52 by the tug 60. The valve components are so dimensioned that upon the ball 58 being located as shown in FIG. 5, i.e. pulled through the hub 52, the body of the valve 54 will be slightly deformed due to the engagement of the valve periphery with the inlet spider seat 50, FIG. 5, and this slight deformation of the valve 54 will maintain the valve normally closed except when air is being drawn into the inlet passage 40 through port 26.

In a similar manner, the valve cover 46 includes an exhaust spider 64 having an annular seat 66 and a hub 68. The resilient diaphragm valve 70 engages the seat 66, and in a manner similar to that described above with respect to valve 54, the valve 70 is slightly deformed under its elasticity to maintain a normally closed relationship with respect to the seat 66 and port 28 except when air is being exhaled through the spider 64. As will be appreciated, the valve 54, due to its communication with inlet passage 40, opens upon air being drawn into the passage 40, while the valve 70 is in communication with the exhaust passage 42 and opens upon exhaust air passing through the passage 42. As both valves 54 and 70 are normally closed, the snorkel interior is maintained "dry" even if the snorkel is submerged.

The mouthpiece 18 is molded of rubber, or the like, and includes a unidirectional valve 72 of the diaphragm type, the valve including the spider 74 and the diaphragm valve 76 which normally engages the spider 74 and is normally closed. Mouthpiece valve 72 is for the purpose of draining the passages of the body 12 in the event that water becomes trapped therein during snorkel use.

It is customary to support the snorkel 10 by the strap of the diver's goggles, not shown, and to this end, the body 12 includes an integral strap clamp 78 homogeneously defined on the body halves 30 and 32 during fabrication. The strap clamp 78 includes a hinge 80, FIG. 2, a shoulder 82 and a clamp area 84. The cover 86 is hinged to the hinge 80 by the cover hinge pin configuration 88, and the cover includes a lip 90 adapted to snap over the shoulder 82 locating the cover clamp area 92 in opposed relationship to the clamp area 84. The clamp areas 84 and 92 may be serrated to aid in the gripping of a goggle strap between the areas 84 and 92. As the cover 86 is formed of a resilient thermoplastic material, it may be readily pivoted between goggle strap clamping and release positions.

The snorkel of the invention is used in the normal manner. The downward direction of the air inlet port 26 and air exhaust port 28 toward the mouthpiece 18 is of significant advantage in discouraging the entrance of water into the snorkel as water is shed from the upper regions of the snorkel upper side 20, and as the snorkel is moved through the water during swimming, the positioning of the ports 26 and 28 minimizes the unintentional opening of the valves 54 and 70 due to water pressure being imposed thereon due to snorkel movement. The unusual appearance and attractiveness of a snorkel incorporating the inventive concepts will be appreciated from FIG. 1, and the practice of the invention permits a very high quality snorkel to be manufactured at reasonable cost.

It is appreciated that various modifications to the inventive concepts may be apparent to those skilled in the art without departing from the spirit and scope of the invention.

What is claimed is:

1. A diving snorkel comprising, in combination, an elongated tubular body having a lower end and an upper end with respect to its orientation during use, said upper end having upper and lower sides, a mouthpiece mounted on said body lower end in communication with said body, said body upper end lower side facing said mouthpiece, an inlet air passage and an exhaled air exhaust passage defined in said body extending between said body ends, both said passages being in communication with said mouthpiece at said body lower end, a double valve housing in said body upper end lower side having an air inlet port in communication with said air inlet passage and an air exhaust port in communication with said air exhaust passage, a first unidirectional valve located in said air inlet port permitting air flow into said inlet port only and a second unidirectional valve located in said air exhaust port permitting air flow from said exhaust port only, said unidirectional valves each comprising a flexible diaphragm having a center and a periphery, said valves being mounted within the associated port at their center and engaging a port seat at their periphery, and a normally closed water exhaust valve defined in said mouthpiece permitting water to drain from said body and passages defined therein, said tubular body being formed of a synthetic molded material, a strap clamp defined on said body, said clamp comprising a hinge, a shoulder and a clamp area, said clamp area being homogeneously defined on said tubular body between said hinge and said shoulder comprising a plurality of serrations molded into said tubular body, a cover pivotally mounted upon said hinge, and a lip defined on said cover adapted to snap over said shoulder upon said cover being superimposed over said clamp area.

* * * * *